United States Patent [19]

Moeller et al.

[11] 4,243,174

[45] Jan. 6, 1981

[54] METHOD AND APPARATUS FOR CONTROL OF AIR FLOW TO A PLURALITY OF ROOMS

[76] Inventors: Chris R. Moeller, 211 Axilda, Houston, Tex. 77017; George L. Slanina, 814 Overland, Stafford, Tex. 77477

[21] Appl. No.: 79,512

[22] Filed: Sep. 27, 1979

[51] Int. Cl.[3] ..... G05D 23/32

[52] U.S. Cl. ..... 236/46 R; 236/49

[58] Field of Search ..... 236/46 R, 49; 165/12

[56] References Cited

U.S. PATENT DOCUMENTS

| | | | |
|---|---|---|---|
| 2,135,742 | 11/1938 | Brace et al. | 165/12 |
| 3,051,451 | 8/1962 | Bierwirth et al. | 165/12 |
| 3,785,432 | 1/1974 | Kabat et al. | 236/46 R X |
| 3,934,799 | 1/1976 | Perlmutter | 236/46 R |
| 4,058,253 | 11/1977 | Munk et al. | 236/46 R |
| 4,079,884 | 3/1978 | Sherman | 431/20 X |
| 4,094,166 | 6/1978 | Jerles | 236/46 R X |
| 4,147,298 | 4/1979 | Leemhuis | 137/499 X |
| 4,150,718 | 4/1979 | Kolbow et al. | 236/46 R X |

*Primary Examiner*—William E. Tapolcai, Jr.
*Attorney, Agent, or Firm*—Neal J. Mosely

[57] ABSTRACT

Control apparatus for the automatic opening and closing of electrically operated dampers installed in home central heating and air conditioning ducts to control air flow to a plurality of rooms for the expressed purpose of energy conservation. A programmable timer is provided for adapting the control apparatus to the life styles of the user. Manually operable switches are also provided to allow for unscheduled events requiring temporary deviation from damper program for a given room, and to allow for constant bypass of the damper program leaving damper in the fully open or fully closed position. Utilizing this apparatus to greatly reduce air flow to unoccupied rooms, thereby, reducing volume of home air conditioned or heated space on a scheduled basis, will achieve energy conservation, thereby fulfilling the intentions of this invention.

10 Claims, 2 Drawing Figures

METHOD AND APPARATUS FOR CONTROL OF AIR FLOW TO A PLURALITY OF ROOMS

BACKGROUND OF INVENTION

This invention relates in general to the method and control apparatus used with home air conditioning and/or heating units to control the volume of heated or air conditioned space. Being designed in particular to conserve energy, the automatic control apparatus operates in conjunction with existing temperature controls. To date, all devices and patents reviewed consisted of timed set back thermostats, automatic damper systems to control room temperatures, or multiple thermostatic controls; none of which specifically addressed energy conservation through the use of an apparatus to control the volume of heated or air conditioned space based on a programed timed sequence.

Most residences have many rooms that are occupied only part time and on a regular schedule. For example, the kitchen, living room, dining room, recreation room, etc., are not occupied during sleeping hours, while bedrooms are occupied. For economic reasons it is desirable during unoccupied periods to discontinue heating or air conditioning the unoccupied rooms. In many instances, it is not desirable to completely isolate an unoccupied room. For this reason, each electrically operated damper is designed to allow 10 to 20 percent of original air flow to each unoccupied room.

An example of the usefulness of this apparatus can be illustrated by a typical working family in which the bedrooms are unoccupied during the day and are occupied during the night only. This family could program the apparatus to switch heated or air conditioned air from awake time areas to sleep time areas of the home and back to awake time living areas automatically according to their life style. Families requiring bedroom use continuously, for example, a family with small children, could use the bypass feature to continuously heat or air condition bedrooms, and program apparatus to discontinue air flow to kitchen, living room, etc., during sleeping hours. The bypass feature would also allow a family to indefinitely discontinue heating or air conditioning an unused or seldom occupied room.

SUMMARY OF THE INVENTION

It is, therefore, a principal object of this invention to provide programmable control apparatus for a plurality of rooms for economic benefit to the user through energy conservation, i.e., using air conditioning and/or heating units in a most economical way.

It is a further object to provide a manual override capability in the event of continuous or unscheduled occupancy.

It is a further object of the electrically operated damper apparatus to provide a minimum air flow to each room when the damper is in the closed position to avoid mildew, musty odors, and to avoid temperature extremes.

It is another object to provide thermal cutouts to protect system from temperature extremes resulting from accidental over restriction of air flow created by too many dampers being closed during the heating or air conditioning mode, thus providing for fail-safe operation.

A still further object of the electrically operated damper apparatus is to open automatically upon loss of power to provide fail-safe operation.

Another object is to operate independently of temperature controls or settings. However, apparatus is designed to interface existing thermostatic controls so that electrically operated dampers can be energized only when heater or air conditioner is energized and is in agreement with damper program. Thus, system power usage can be minimized, realizing greater economic benefits to user.

It is still another object to provide retrofit capability on existing heating and/or air conditioning systems as well as integral installation with new heating and/or air conditioning systems.

It is a requirement for most economic operation to have a thermostat control located within close proximity of return air duct of heating and/or air conditioning unit.

Features of the invention useful in accomplishing the above objects include a programmable timer for operating a peripheral driver. The peripheral driver allows programmable timer to indirectly actuate electrically operated dampers in a "flip-flop" fashion, allowing for the automatic control of a plurality of rooms. A relay to be wired in series with existing thermostat is energized when thermostat energizes heating or air conditioning and closes normally open contacts to supply electrically operated dampers with power according to program. Electrically operated dampers are spring returned to the normally open position when de-energized or upon loss of power to provide a fail-safe operation. Manual three position switches provide users with timed automatic, continuously open, or continuously closed options for electrically operated damper program.

BRIEF DESCRIPTION OF THE DRAWINGS

A specific illustrative embodiment representing what is presently regarded as the best mode of carrying out the invention is illustrated in the two accompanying drawing figures.

DESCRIPTION OF THE PREFERRED EMBODIMENT

Figure 1:
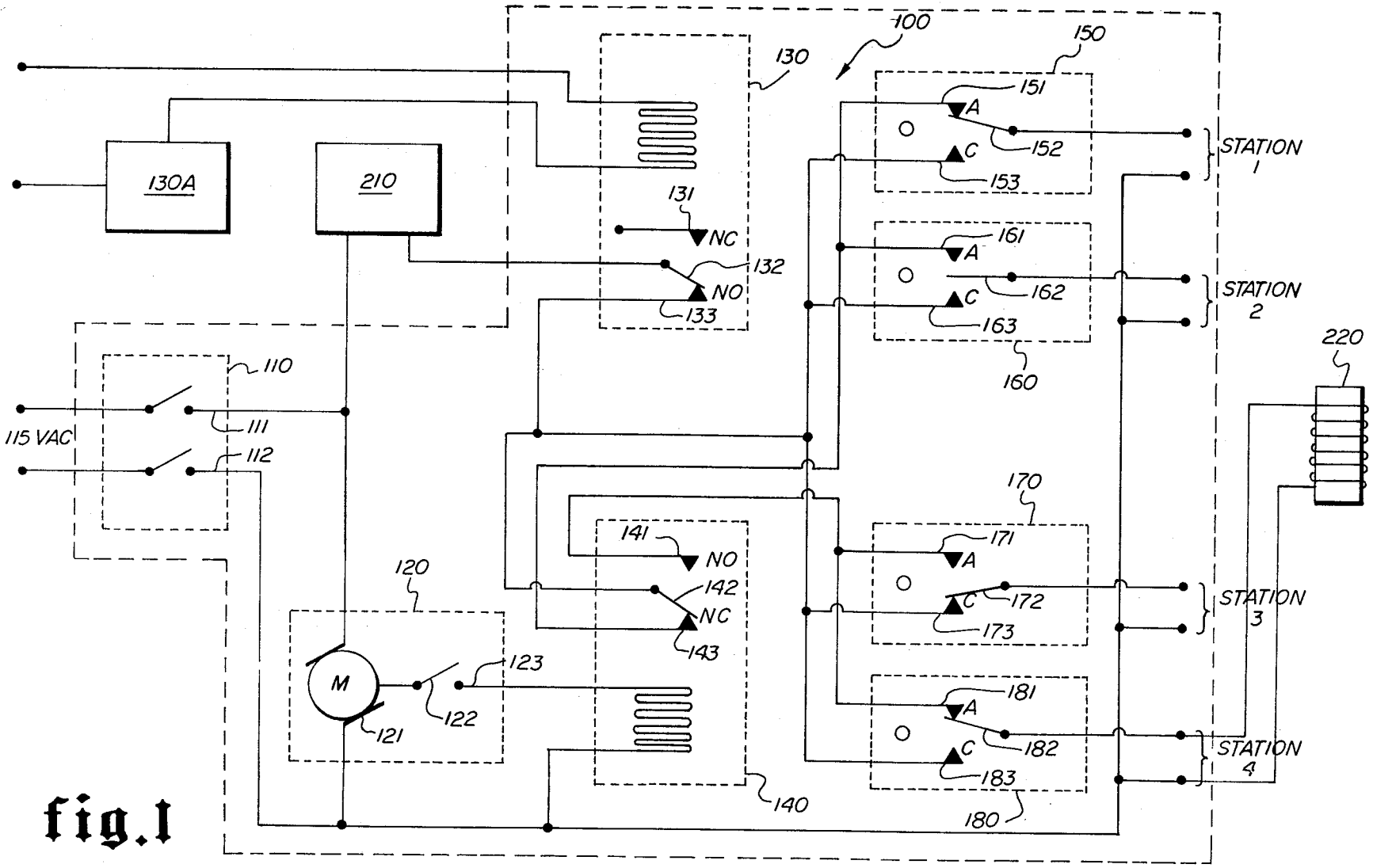
FIG. 1 is a schematic circuit diagram.

Referring to FIG. 1:

For the purposes of illustration, control apparatus 100 is shown connected between a source of 115 volt 60 cycle AC and four damper control stations, with each station capable of controlling one or more electrically operated dampers. The electrically operated dampers may be controlling the flow of air conditioned or heated air. An electrically operated damper solenoid 220 is shown connected to station 4 for the purpose of illustration. Stations 1 thru 4 are controlled by a programmable timer indirectly through peripheral driver 140 which energizes manual/automatic control switches 150 and 160 or 170 and 180, as called for by programmed schedule. It is expressly understood that the four station connections have been shown for illustrative purposes only. The exemplary embodiment may be expanded to control many more stations or reduced to control fewer stations. Additionally, the principles of this invention allow for the exemplary embodiment to be modified to activate damper stations individually through the use of multi-contact programmable timers or programmable electronic timers utilizing peripheral drivers. Also, the expressed method of automatic control of air flow to a plurality of rooms could be achieved by utilizing components commercially available without departing from the spirit of this invention. In addition, the apparatus described here in, should not be limited to only the functions embodied with in this invention.

Control apparatus 100 is energized when double pole single throw switch 110 is closed, making contacts 111 and 112. The line voltage 115 volts 60 cycle AC is then applied to motor 121 of timer 120. Other voltages and frequencies may be utilized in the event it is so desired. Timer 120 is a programmable timer and may be of the 7 day or 24 hour variety. Such a timer typically comprises a contact 122 which is rotated by motor 121. "ON" contact 123 may be engaged with contact 122 for predetermined periods of the 7 day or 24 hour period. Programmable timer 120 may be of any commercially available variety that satisfies the requirements of any particular application of this invention.

When motor 121 moves contact 122 into engagement with "ON" contact 123, peripheral driver 140 is energized moving contactor 142 from the normally closed (NC) contact 143 to engage normally open (NO) contact 141.

Thermostat controlled relay 130 is wired in series with existing thermostat 130A. When existing thermostat 130A energizes heating or air conditioning unit, the current sensing thermostat controlled relay 130 is energized, and contactor 132 is moved from the normally closed (NC) contact 131 to engage normally open (NO) contact 133. As long as high and low temperature contacts 210 are closed, line voltage is supplied to contactor 132 of current sensing thermostat controlled relay 130.

With contactor 132 engaging contact 133, line voltage is supplied to contactor 142 of peripheral driver 140. With contactor 142 engaging contact 141, voltage is supplied to contact 171 of manual/automatic switch 170 and contact 181 of manual/automatic switch 180 only. When peripheral driver 140 is de-energized, i.e., contractor 122 is no longer engaged to contact 123 of timer 120, contactor 142 engages contact 143, thus supplying voltage to contact 151 of manual/automatic switch 150 and to contact 161 of manual/automatic switch 160 only.

With contactor 132 engaging contact 133, line voltage is also supplied directly to contacts 153, 163, 173, and 183 of manual/automatic switches 150, 160, 170, and 180 respectively.

When existing thermostat 130A is satisfied and deenergizes heating or air conditioning unit, thermostat controlled relay 130 is deenergize and voltage is no longer supplied to contactor 142 of peripheral driver 140 or contacts 153, 163, 173, and 183 of manual/automatic switches 150, 160, 170 and 180 respectively.

The manual/automatic switches 150, 160, 170, and 180 are of the single pole double throw, or "ON-OFF-ON", variety. For purposes of illustration, manual/automatic switches 150 and 180 are shown in the AUTOMATIC (A) damper position, i.e., contactor 152 is engaged with contact 151 and contactor 182 is engaged with contact 181. Likewise manual/automatic switch 160 is shown in the neutral position or MANUAL OPEN (O) damper position and contactor 162 is in engaged with no contact. In similar manner, manual/automatic switch 170 is shown in the MANUAL CLOSED (C) damper position, i.e., contactor 172 is engaged with contact 173.

With manual/automatic switch 180 in AUTOMATIC (A) damper position with thermostat controlled relay 130 energized, peripheral driver 140 energized, and thermal contacts 210 closed, voltage would be supplied to and energize electric damper solenoid 220 according to timer program. If contactor 182 is placed in the neutral or MANUAL OPEN (O) damper position, electric damper solenoid 220 would remain in the de-energized position, unaffected by program sequence or relay operation. If contactor 182 is engaged with contact 183, i.e., in the MANUAL CLOSED (C) damper position, the electric damper solenoid 220 would remain energized, unaffected by program sequence as long as thermostat controlled relay 130 is energized.

Figure 2:
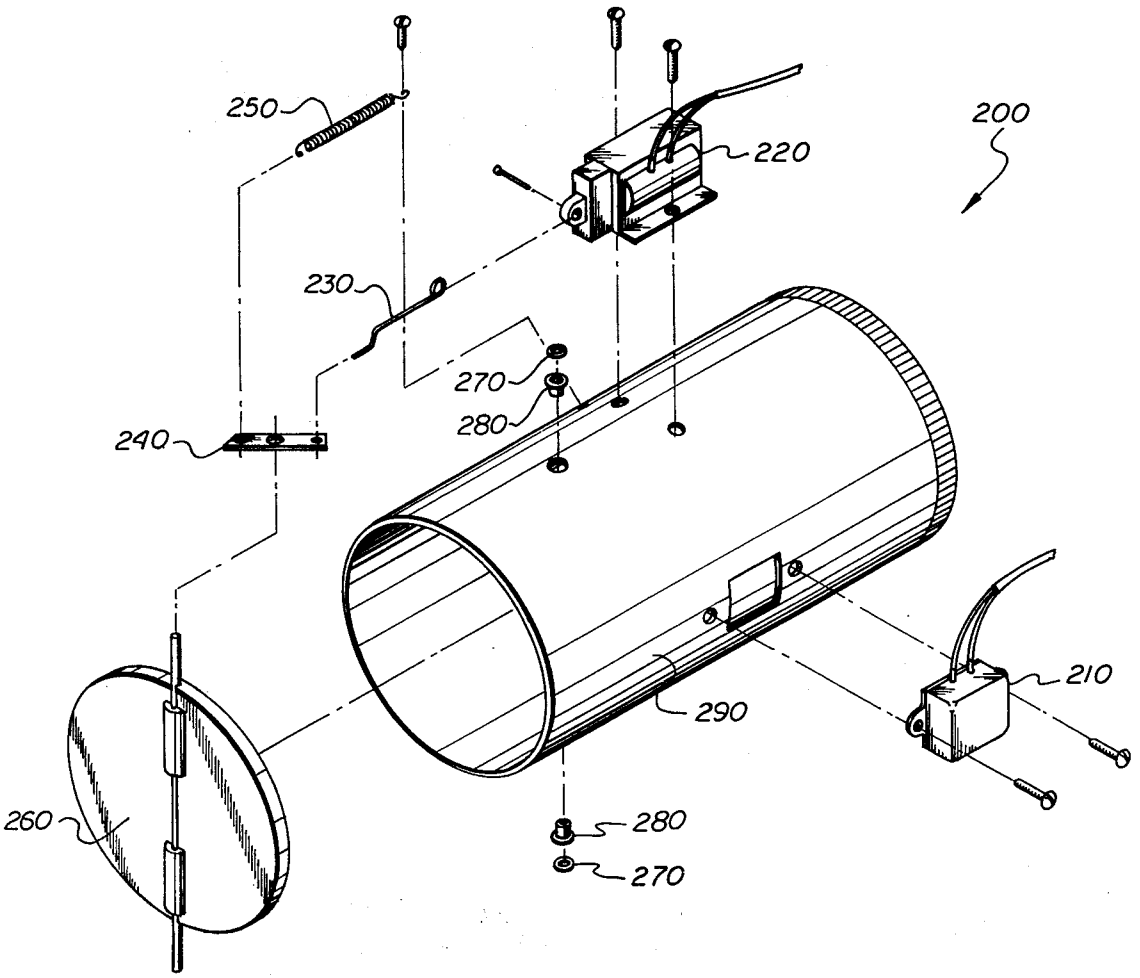
FIG. 2 is an exploded perspective view of the electrically operated damper.

Referring now to FIG. 2:

For the purpose of illustration, FIG. 2 typlifies a preferred embodiment for the electrically operated damper apparatus 200. Other damper, duct, and linkage configurations could be utilized to accomplish similar results without departing from the essence of this invention. Also, the expressed method of damper activation could utilize rotating solenoids, motors, and pneumatic systems without departing from the spirit of this invention.

When the electric damper solenoid 220 is energized by the automatic multiple damper control apparatus 100, solenoid plunger seats in solenoid 220, pulling linkage 230 which is pinned to solenoid plunger. Linkage 230, in turn, causes damper shaft arm 240 to rotate 90° while pulling against spring assembly 250. Damper shaft arm 240, being permanently attached to damper and shaft assembly 260, likewise, causes damper and shaft assembly 260 to rotate 90°, from the free air flow open position to the fully closed position with approximately 10 to 20 percent air flow maintained due to duct and damper radius differential. Bushings 280, installed in air duct 290, allow for nonbinding rotational operation of damper and shaft assembly 260. Self-locking retaining washers 270 center damper and shaft assembly 260 in air duct 290. Upon loss of power, spring assembly 250 returns damper and shaft assembly 260 to the original full open position. High and low temperature contacts 210 (one set required per entire damper and control apparatus system) are mounted through air duct 290 wall.

There has thus been described a method and apparatus for the control of air flow to a plurality of rooms in a programmable and energy conserving manner. The apparatus is fail-safe in that in the event of accidental over restriction of air flow or loss of power, the electrically operated damper returns to the de-energized or open position. There is also the provision of a manual override capability bypassing programmed control. There is still another provision to allow for damper operation only during periods of heating or air conditioning unit operation.

Whereas this invention is herein illustrated and described with respect to a specific embodiment thereof, it should be realized that various changes may be made without departing from the essential contributions to the art made by the teachings hereof.

We claim:

1. In a system for maintaining and controlling temperature in rooms of a building including heating and/or cooling means, a thermostat controlling energization of said heating and/or cooling means in response to temperature in said building, means, including air ducts, to circulate air from said heating and/or cooling means to said rooms for heating or cooling the same;

an energy economizing system comprising at least one damper in an air duct controlling air circulation to one of said rooms and biased to a normally open position, electrically operated actuating means operable upon energization to move said damper to a substantially closed position, time operated switch means having contacts operatively connected in circuit with said damper actuating means and operable to close said damper at a selected time, normally open relay switch means positioned in the circuit from said time operated switch means to said damper actuating means and connected for actuation in response to closing of said thermostat, and said time operated switch means being operable to energize said damper actuating means to close said damper only when said thermostat is closed.

2. A system according to claim 1 in which said damper upon actuation by said actuating means only partially closes said air duct.

3. A system according to claim 2 in which said time operated switch means is a programmable timer having contacts for controlling a plurality of circuits.

4. A system according to claim 3 in which said programmable timer is one which repeats according to a selected time cycle.

5. A system according to claim 2 in which said relay switch means comprises a peripheral driver.

6. A system according to claim 2 in which said damper is spring biased to a normally open position, and said damper actuating means is an electric solenoid.

7. A system according to claim 2 in which thermostatic switch means is provided adjacent to said damper to respond to predetermined high and low temperatures of circulating air to open the circuit from said time operated switch to said damper actuating means to deenergize the same.

8. A system according to claim 2 including manually operated switch means having manually closable contacts in circuit with said damper actuating means for energizing and deenergizing the same independently of said time operated switch means, and manually closable contacts in circuit with said damper actuating means and said time operated switch means for establishing control thereby.

9. A system according to claim 2 in which there are a plurality of dampers controlling air flow to a plurality of rooms, and a plurality of damper actuating means controlled by said time operated switch means.

10. A method of reducing energy use by central heating and/or cooling apparatus which comprises circulating heated or cooled air to a plurality of rooms through air ducts controlled by electrically actuated dampers, normally biased to an open position, circulating said heated or cooled air in response to demand for heating or cooling by a room thermostat, and closing selected dampers to substantially shut off the flow of air to selected rooms by energizing the electrical actuating means therefor at selected times by time operated switch means, but only closing said dampers when circulating of air is effected in response to demand for heating or cooling by said thermostat.

* * * * *